United States Patent [19]

Kunzmann et al.

[11] 4,197,773

[45] Apr. 15, 1980

[54] DEVICE FOR CUTTING A WEB INTO PREDETERMINED SECTIONS

[75] Inventors: Anton Kunzmann; Bernd Kunzmann, both of Wellendingen, Fed. Rep. of Germany

[73] Assignee: Guk-Falzmaschinen Griesser & Kunzmann GmbH & Co. KG, Wellendingen, Fed. Rep. of Germany

[21] Appl. No.: 911,703

[22] Filed: Jun. 1, 1978

[30] Foreign Application Priority Data

Jun. 3, 1977 [DE] Fed. Rep. of Germany ... 7717603[U]

[51] Int. Cl.[2] ..... B26D 5/34

[52] U.S. Cl. ..... 83/209; 83/241; 83/245; 83/275; 83/336; 83/365

[58] Field of Search ..... 83/209, 210, 231, 244, 83/275, 295, 313, 324, 336, 365, 241, 369

[56] References Cited

U.S. PATENT DOCUMENTS

| | | | |
|---|---|---|---|
| 1,786,992 | 12/1930 | Gronemeyer | 83/313 |
| 3,083,602 | 4/1963 | Obenshain | 83/336 |
| 3,706,247 | 12/1972 | Clark | 83/209 X |
| 3,743,413 | 7/1973 | Sharp et al. | 83/209 X |
| 3,937,112 | 2/1976 | Geeson | 83/209 X |

*Primary Examiner*—Donald R. Schran
*Attorney, Agent, or Firm*—Michael J. Striker

[57] ABSTRACT

The device for cutting a web into sections according to cutting marks provided on the web comprises an advancing roller for advancing the web along a predetermined track, an electrooptical scanning device for reading respective cutting marks on the web and for generating corresponding output signals, a cutting mechanism arranged on the track behind the advancing roller and monitored by the scanning, a tension equalizing and loop forming device arranged on the track before the advancing roller and the scanning device to loop resiliently a portion of the web, an elliptical gear driving system for driving the advancing roller; and a magnetic coupling arranged between the driving system and the advancing roller to stop the feeding of the web in response to the output signals from the scanning device and to resume the feeding after the cutting mechanism has severed the marked web portion.

8 Claims, 1 Drawing Figure

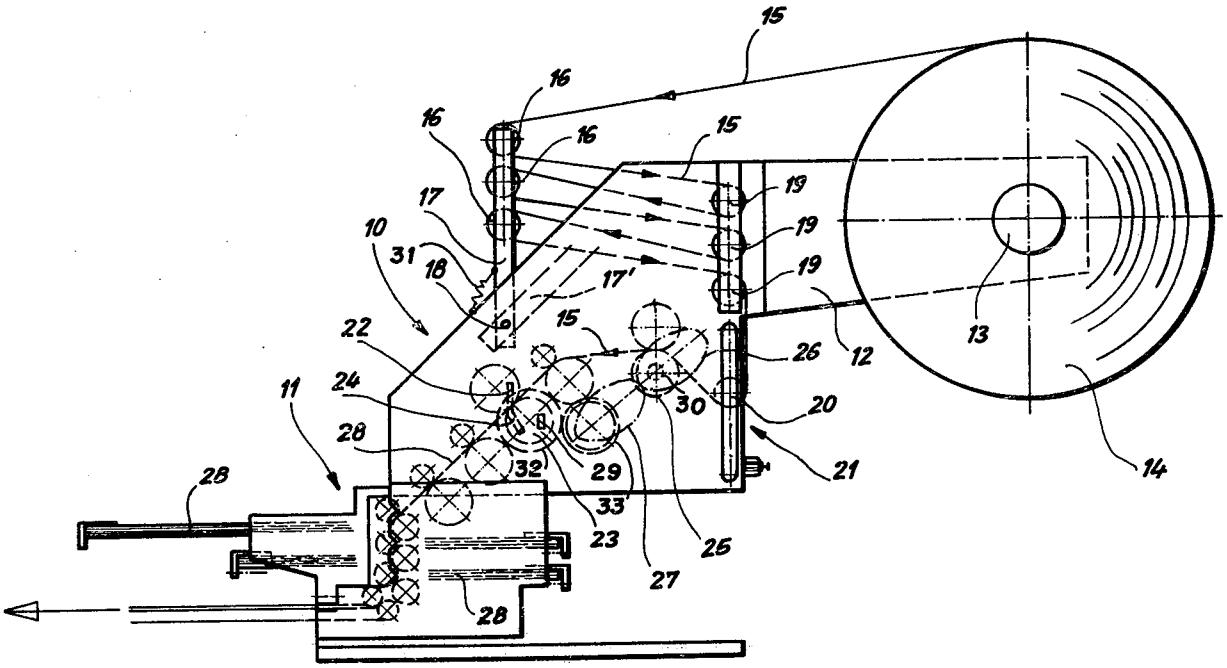
14
13
12
21
20
26
19
19
19
15
15
25
30
27
33
23
29
17'
15
16
16
32
28
16
17
18
31
10
22
24
28
11
28

DEVICE FOR CUTTING A WEB INTO PREDETERMINED SECTIONS

BACKGROUND OF THE INVENTION

This invention relates generally to cutting devices for separating into individual sections a web fed from a roll.

In particular, this invention is concerned with a device for cutting a web, such as a roll of printed paper, into predetermined sections according to cutting marks provided on the web.

The known devices of this type include at least one driven and exchangeable take-up roller, a device for electro-optically scanning the cutting marks on the web, a cutting mechanism controlled by the scanning device and a folding device for folding the separated web sections.

From the prior art so-called automatic roller cutting and folding machines are known in which a printed web is intermittently advanced and severed along straight cutting lines and subsequently folded in an edging and folding device. Such known devices are used for example in connection with packing devices for cutting and folding instruction leaflets for pharmaceutical products.

In the application of such machines, however, it has been shown that they do not meet the requirements for optimum operation in all application cases and that intermediate storing devices have to be used for the web sections because otherwise an accurate synchronization of the cutting machine with the subsequent packing machine would be impossible.

SUMMARY OF THE INVENTION

It is therefore a general object of the present invention to overcome the aforementioned disadvantages.

More particularly, it is an object of the invention to provide an improved cutting device of the aforedescribed type that can be better adjusted to different feeding speeds of the web and/or for cooperation with intermittently operating packing devices.

A further object of this invention is to provide such an improved cutting device that enables an accurate cutting of web sections according to predetermined marks on the web.

In keeping with these objects, and others which will become apparent hereafter, one feature of the invention resides in a cutting device of the above-described type, in a combination which comprises an advancing roller driven by an elliptical gear driving system in such a manner that it advances the web to the cutting knives at variable speeds, a tension equalizing and loop-forming or web storing mechanism arranged in the feeding track of the web, and an optical scanning device for detecting cutting marks on the web and for controlling the cutting operation.

The cutting device according to this invention enables an intermittent as well as a continuous operation and due to the elliptic gear drive, it is possible to achieve very exact cuts of the web.

Preferably, the distance between the electro-optical scanning device and the advancing roller is adjustable. The periphery of the advancing roller corresponds to the length of sections to be cut and in this manner by exchanging the advancing roller for another one having different diameter, the position of the scanning device can be adjusted according to the circumferences of the new roller. The shaft supporting the cutting knife is driven continuously, for example by means of a chain from the drive of a packing machine whereby only the actuation of the advancing roller is controlled. In this manner, it is possible to feed leaflets or booklets into the packing machine at any time intervals.

The tension equalizing and loop-forming device ensures that the cutting machine could instantly start its operation at a desired web feeding speed on the one hand and at a less abrupt acceleration of the web roll on the other hand so that no breaking or pulling apart of the web can take place. Preferably, the tension equalizing and loop-forming device includes several guiding rollers supported for rotation on a common rocking or swinging frame that is biased by a tension spring into a rest position, and also includes stationary guiding rollers cooperating with the swingably supported rollers so that the web is guided back and forth from one rocking roller to the juxtaposed stationary roller. It is advantageous when the rocking frame is coupled to a control device for controlling a brake for the web roll so that the unwinding speed of the web is adjusted in response to the position of the rocking roller. This braking device makes it possible that in the case of interruption of the operation of the web cutting device the web roll can also be brought to standstill in due time.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE shows schematically in a side view an example of the web cutting device according to this invention.

DESCRIPTION OF THE PREFERRED EMBODIMENTS

The web cutting device 10 of this invention is shown in connection with subsequently arranged folding device 11 that forms an additional installation of a packing device (not shown).

The web cutting device 10 of this invention has a supporting arm 12 the free end of which is provided with an arbor 13 for supporting a foil or web roll 14. The web 15 is wound off the roll 14 and fed onto a track defined by a set of guiding rollers 16 (here three) supported for rotation on a swinging frame 17 that in turn is swingably supported for rotary movement about axis 18 from a normal or rest position to a swung-open position indicated by dashed lines 17'. The swinging arm 17 is held in its normal position by a biasing spring 31 so that it is tilted into its swung open position against the force of the biasing spring. In the tilted position the guiding rollers 16 approach a corresponding set of stationary guiding rollers 19. The guiding rollers 16 and 19 together with swinging frame 17 form a tension equalizing or loop-forming device for accumulating or storing a portion of the web 15. The web 15 is first guided past the uppermost guiding roller 16 on the rocking frame 17 and therefrom past the uppermost stationary guiding roller 19 and further alternately back and forth past the subsequent guiding rollers 16 and 19 until it is guided from the lowermost stationary guiding roller 19 to a detached stationary guiding roller 20 pertaining to an electro-optical scanning device 21. This scanning device can be of any suitable known type, such as for example a detector of a light beam reflected from the web and intercepted by a photocell that in response to the occurrence of cutting marks printed on the web 15 issues at its output corresponding control signals.

The control signals from the electro-optical device 21 are also employed to control in a conventional manner by means of devices 29 and 30 which will be explained below the driving system 27 for the web advancing roller 25. The actuation of the roller 25 is started in response to a specific position of the knife supporting shaft 23 and as soon as the cutting mark reaches the cutting knives the roller 25 is stopped again. The feeding speed of roller 25 is, of course, adjusted such as to exceed the rotary speed of the knife 24. Immediately upon this stopping, the cutting mechanism that includes a stationary cutting knife 22 extending over the entire breadth of the web and a counteracting knife 24 mounted on the continuously rotating cutting shaft 23, severs the web along the cutting mark. The cutting or severing action thus takes place during stand-still of the web 15 whereby the knife-supporting shaft 23 is coupled by means of a driving chain, for example to a separate drive in a packing device. The scanning device 21 also includes a separate electronic synchronization monitoring device 29 assigned to the shaft 23 for comparing the position of the printed cutting mark with the instant position of the cutting shaft 23 and for actuating the roller 25 in response to the predetermined position of the knife 24. In the absence of a cutting mark (that indicates also the absence of prints on the web) the machine is automatically switched off. In this manner, only those printed web sections that are printed on proper places are forwarded for cutting. Accurate synchronization in the ratio of 1:1 is ensured for example in all ranges of feeding speeds between 0 and 300 sections to be cut per minute.

The roller 25 can be selectively connected to and disconnected from the elliptic driving system 27 by means of a device 30 including a magnetic coupling and a magnetic brake. This arrangement facilitates exact severing of the advancing web at desired locations which have been predetermined by printed marks.

The roller 25 that advances the web 15 to the cutting mechanism 22 to 24 is exchangeably arranged in the device 10 so that its circumference can be adjusted to correspond exactly to the length of web sections to be cut.

The roller 25 is driven by means of an elliptical gear driving system coupled thereto, as mentioned above, via a magnetic coupling and magnetic brake. In the drawing the elliptical gears are illustrated only symbolically by means of two meshing elliptic gears 26 and 27, the gear 27 being driven via transmission gears 32 and 33 by the shaft 23. These meshing elliptic gears are adjusted so that the feeding speed of the web is minimum during the reading or scanning of the printed cutting mark and subsequently the speed is accelerated. This variable speed results in high average feeding speeds of the web and at the same time in an exact scanning and cutting operation.

After the cutting operation has been finished, the severed sections 28 of the web which are discharged from the cutting mechanism 22 to 24 are forwarded into a subsequently arranged folding device 11 which can be of any conventional type and need not be described in detail.

The operation of the cutting device of this invention is as follows:

As soon as the requirement for the delivery of web sections is announced, the roller 25 is coupled via a magnetic coupling in the device 30 to the driving elliptic gear system 26 and 27. This elliptic gear rotates the roller 25 at periodically changing speeds. Since the circumference of the roller 25 corresponds exactly to the length of web sections 28 to be cut, the web 15 is advanced by the roller 25 in each cycle of the elliptical gear by a distance corresponding to about the length of the web section. The mutual position of the roller 25 and of the electro-optical scanning device 21 is adjusted so that the scanning of a cutting mark printed on the web 15 takes place always during the minimum speed of the web 15.

The variations in feeding speed of the web 15 resulting from the variable rotation of the roller 25 are neutralized by means of a swinging movement of a rocking frame 17 in the tension equalizing and loop-forming device so that roll 14 of the web is decoiled with at least approximately uniform speed. The tension equalizing and loop-forming arrangement has moreover the advantage that in starting the rotation of the roller 25 the web is first delivered from the loops between the guiding rollers until the rocking frame is turned into the swung-open position indicated by dashed lines 17'. Subsequently, the pull exerted by the roller 25 is with delay transmitted to the web roll 14 so that as soon as the spring biased rocking frame 17 is returning to its normal position the decoiling of the roll 14 is slowly accelerated according to the motion of the frame until web 15 restores its full length in the loops between the guiding rollers 15 and 19 and the rocking frame 17 resumes its normal or rest position.

The rocking frame 17 takes always this rest position as soon as the roller 25 is disconnected from its driving system and before the braking device (not shown) stops the movement of the roll 14.

It will be understood that each of the elements described above, or two or more together, may also find a useful application in other types of constructions differing from the types described above.

While the invention has been illustrated and described as embodied in a web cutting machine for use with printed webs, it is not intended to be limited to the details shown, since various modifications and structural changes may be made without departing in any way from the spirit of the present invention.

What is claimed as new and desired to be protected by Letters Patent is set forth in the appended claims.

1. A device for cutting a web into sections corresponding to cutting marks provided on the web, comprising an advancing roller for feeding said web along a predetermined track; a continuously rotating cutting mechanism arranged on said track downstream of said advancing roller to sever said web; a scanning device for generating output signals corresponding, respectively, to the occurrence of a cutting mark upstream of said advancing roller and to a predetermined position of said cutting mechanism after the severing operation; a continuously driven elliptical gear driving system for driving said advancing roller at a periodically variable speed, said driving system being so adjusted relative to the circumference of said advancing roller as to feed the marked portions of said web past said scanning device at a minimum speed; coupling means arranged between said advancing roller and said driving system, said coupling means being controlled by said output signals to interrupt the feeding of said web during a time interval between the reading of a cutting mark and said predetermined position of the cutting mechanism; and a tension equalizing and loop-forming device arranged on said track upstream of said advancing roller to resiliently accumulate a portion of said web.

2. A device as defined in claim 1 wherein said cutting mechanism includes a driven knife-supporting shaft and said elliptical gear driving system for said advancing roller being driven by said shaft.

3. A device as defined in claim 2, further including a separate drive for driving said knife-supporting shaft.

4. A device as defined in claim 1 wherein said advancing roller is exchangeable for another take-up roller having a different diameter and the distance of said scanning device relative to said advancing roller being adjustable so that the scanning of cutting marks takes place during minimum feeding speeds of the web.

5. A device as defined in claim 4 wherein said tension-equalizing and loop-forming device comprises two sets of facing guiding rollers, at least one set being supported for reciprocable movement relative to the other set and being spring biased away from said other set.

6. A device as defined in claim 5 wherein said one set is supported on a spring biased swingable frame and the other set is supported on a stationary support, said web being alternately guided first past said movable rollers and the juxtaposed stationary rollers.

7. A device as defined in claim 1 wherein said web is a paper web.

8. A device as defined in claim 7 further including a folding device arranged behind said cutting mechanism for receiving and folding the severed web sections.

* * * * *